US009083123B2

(12) United States Patent
Homan

(10) Patent No.: US 9,083,123 B2
(45) Date of Patent: Jul. 14, 2015

(54) VISUALLY EVIDENT CONNECTION SYSTEM FOR PLUG-IN POWER/DATA CABLE

(71) Applicant: TAIT TOWERS MANUFACTURING, LLC, Lititz, PA (US)

(72) Inventor: Rob Homan, Lancaster, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 141 days.

(21) Appl. No.: 13/927,737

(22) Filed: Jun. 26, 2013

(65) Prior Publication Data

US 2015/0004832 A1 Jan. 1, 2015

(51) Int. Cl.

| | |
|---|---|
| ***H01R 3/00*** | (2006.01) |
| ***H01R 13/717*** | (2006.01) |
| ***H01R 13/703*** | (2006.01) |

(52) U.S. Cl.

CPC ..... *H01R 13/717* (2013.01); *H01R 13/703* (2013.01); *H01R 13/7175* (2013.01); *H01R 2201/04* (2013.01)

(58) Field of Classification Search

CPC ..... H01R 13/641; H01R 13/7175; H01R 13/717; H01R 23/025; H01R 13/6641

USPC ..... 439/490, 488, 910

See application file for complete search history.

(56) References Cited

U.S. PATENT DOCUMENTS

| | | | | |
|---|---|---|---|---|
| 7,670,170 | B2 * | 3/2010 | Henry et al. | 439/490 |
| 8,105,106 | B1 * | 1/2012 | Stoddard | 439/490 |
| 2005/0266723 | A1 * | 12/2005 | Graham et al. | 439/490 |
| 2009/0280677 | A1 * | 11/2009 | Gingrich, III | 439/490 |

* cited by examiner

*Primary Examiner* — Neil Abrams
*Assistant Examiner* — Travis Chambers
(74) *Attorney, Agent, or Firm* — McNees Wallace & Nurick LLC

(57) ABSTRACT

A visually evident connection system for a plug-in power/data cable including a power/data cable connector securable to a power/data cable. The connector is configured to be received by a power/data receptacle having an illumination region. In response to an interconnection between the connector and the receptacle, the connector is configured to provide visual evidence of the interconnection by illumination of a component other than the illumination region of the receptacle. The source of illumination of the component is provided by the illumination region of the receptacle.

12 Claims, 3 Drawing Sheets

VISUALLY EVIDENT CONNECTION SYSTEM FOR PLUG-IN POWER/DATA CABLE

FIELD OF THE INVENTION

The present invention relates to connection systems, and more specifically, to connection systems for transmitting power/data using cables positioned between components.

BACKGROUND OF THE INVENTION

Computers and other devices that exchange data utilize networking technologies. One such networking technology is commonly referred to as the Ethernet, for which operating standards have been established, including wiring, signaling, and modular connectors. For example, an 8P8C modular connector, sometimes referred to as an RJ45 connector is a commonly used modular connector for a Category 5 (Cat 5) cable that is commonly used to carry telephone and video signals. The mating receptacle, such as used with devices referred to as hubs or switches, typically also include a pair of light emitting diodes (LEDs) that are referred to as status lights. Although there are numerous variations, one status light is commonly referred to as an activity status light, and indicates whether there is activity on the Ethernet link. For example, when the Ethernet has established link integrity, and there is transmit or receive activity on the link, the LED associated with the Ethernet activity light flickers. Additionally, the other status light is commonly referred to as a speed light, or the rate at which data is being transmitted. In one configuration, the LED is on or lit only when a reliable Ethernet connection has been established, such as 100 megabytes (Mb) per second and the activity status LED is on.

It is highly desirable to be able to easily determine whether an Ethernet link has been established for a given connection. However, due to a number of reasons, such as space requirements, the location of a hub or switch may not be accessible to permit viewing of the status lights. In an attempt to address this issue, corresponding ends of fiber optic cables have been secured to the activity status lights of an Ethernet receptacle by specially designed brackets mounted to the container housing the Ethernet receptacle. The fiber optic cables extend to a conveniently viewable position, with the light emitted from the LEDs of the status lights being transmitted from the ends of the fiber optic cables associated with the status lights through the fiber optic cables to the opposite ends of the fiber optic cables located in a viewable position.

This set-up has numerous shortfalls. For example, the brackets must be specially designed to be compatible with a particular housing. In addition, there may be insufficient space to accommodate the brackets, especially if the Ethernet links of adjacent Ethernet receptacles are to be monitored in this fashion.

A visually evident connection system usable without requiring brackets secured to the housing containing the Ethernet receptacles and having a sufficiently compact construction to permit monitoring of adjacent Ethernet receptacles would be desirable in the art.

SUMMARY OF THE INVENTION

In an exemplary embodiment, a visually evident connection system for a plug-in power/data cable includes a power/data cable connector securable to a power/data cable. The connector is configured to be received by a power/data receptacle having an illumination region. In response to an interconnection between the connector and the receptacle, the connector is configured to provide visual evidence of the interconnection by illumination of a component other than the illumination region of the receptacle, the source of illumination of the component provided by the illumination region of the receptacle.

In another exemplary embodiment, a visually evident connection system for a plug-in power/data cable includes a body securable to a power/data cable connector configured to be received by a power/data receptacle having an illumination region associated with at least one of connectivity of the receptacle with a power/data source and a data transmission speed or magnitude of electrical power associated with the power/data source. The body includes a passageway formed therein to receive a fiber optic cable such that illumination from the illumination region of the receptacle is transmitted by the fiber optic cable. In response to an interconnection between the connector and the receptacle, the fiber optic cable is configured to provide visual evidence of the interconnection by illumination of a component operatively connected to an end of the fiber optic cable opposite the body, the source of illumination of the component provided by the illumination region of the receptacle.

In another exemplary embodiment, a method of confirming a connection for a plug-in power/data cable includes providing a power/data receptacle having an illumination region. The method further includes providing a power/data cable connector configured to be received by the power/data receptacle. The method further includes interconnecting the connector and the receptacle, wherein in response to an interconnection between the connector and the receptacle, the connector is configured to provide visual evidence of the interconnection by illumination of a component other than the illumination region of the receptacle, the source of illumination of the component provided by the illumination region of the receptacle.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a visually evident connection system for a plug-in power/data cable and a method for confirming a connection for the plug-in power/data cable, such as networking technology commonly referred to as the Ethernet, for which operating standards have been established, including wiring, signaling, and modular connectors. For example, an 8P8C modular connector, sometimes referred to as an RJ45 connector is a commonly used modular connector for a Category 5 (Cat 5) cable that is commonly used to carry telephone and video signals. In another embodiment, a different modular connector and corresponding mating receptacle can be utilized. The visually evident connection system and method is used with a mating receptacle, such receptacle being used with devices referred to as hubs or switches, and typically also including a pair of light emitting diodes (LEDs) or other illumination source that are referred to as status lights. Although there are numerous variations, one status light is commonly referred to as an activity status light, and indicates whether there is activity on the Ethernet link. For example, when the Ethernet has established link integrity, and there is transmit or receive activity on the link, the LED associated with the Ethernet activity light flickers. Additionally, the other status light is commonly referred to as a speed light, or the rate at which data is being transmitted. In one configuration, the LED is on or lit only when a reliable Ethernet connection has been established, such as 100 megabytes (Mb) per second and the activity status LED is on.

The term visually evident is intended to mean that sufficient illumination is provided for an individual or monitoring system or device to detect.

It is to be understood that in one embodiment, an illumination source such as an LED can be associated with a receptacle that is operatively connected to the visually evident connection system. In another embodiment, more than two illumination sources such as LEDs can be associated with a receptacle that is operatively connected to the visually evident connection system. In another embodiment, one or more illumination sources such as LEDs can correspond to activity status (link integrity) and/or a rate at which data is being transmitted, and/or a magnitude of electrical power associated with a power/data source associated with the receptacle. In other words, the connection system of the present disclosure can provide visual evidence of an interconnection between a power/data cable connector and a mating receptacle having one or more illumination sources that can correspond to connectivity of the receptacle with a power/data source and/or a data transmission speed and/or a magnitude of electrical power associated with the power/data source.

Figure 2:
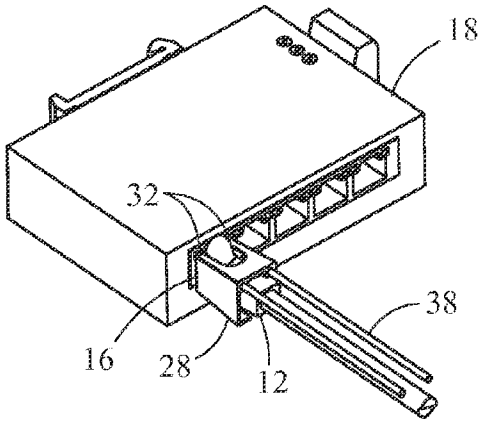
FIG. 2 shows the connection system of FIG. 1 assembled and installed according to the disclosure.
Figure 1:
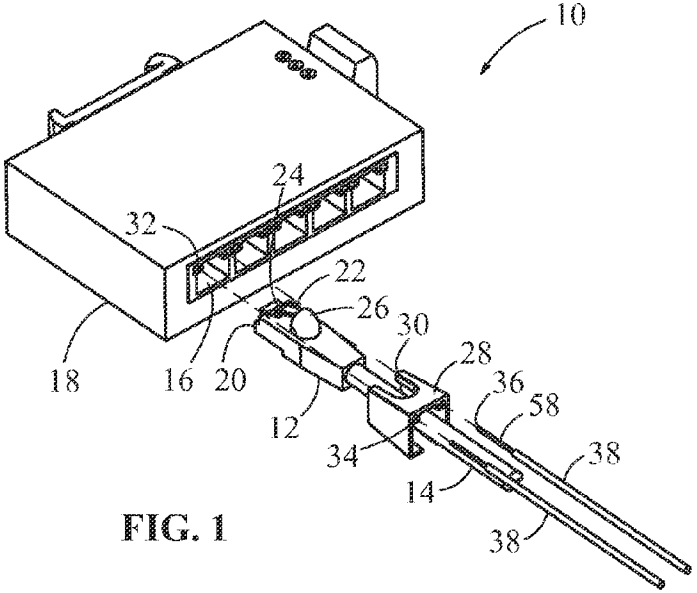
FIG. 1 shows an exploded upper perspective view of an exemplary embodiment of a visually evident connection system according to the disclosure.

FIG. 1 shows an exemplary embodiment of an exploded view of a visually evident connection system 10 prior to assembly and installation of a cable connector 12 in a mating receptacle 16 of a device 18, such as an Ethernet switch or hub which is well known. Cable connector 12 is operatively connected to and extends from an end of a cable 14. Cable connector 12 has an end 20 that is aligned with and directed into receptacle 16 of device 18. As further shown in FIG. 1, cable connector 12 includes an arm 22 associated with an engagement feature 24 that maintains a selective operative connection or interconnection between receptacle 16 and cable connector 12, permitting data transmission and/or electrical power transmission between device 18 and cable 14. As further shown in FIG. 1, cable connector 12 includes a protective feature 26 to protect arm 22 from inadvertent actuation or damage. As further shown in FIG. 1 (and FIG. 2, in which cable connector 12 is operatively connected with receptacle 16) cable connector 12 includes a body 28 that is selectively secured to the cable connector 12.

Figure 6:
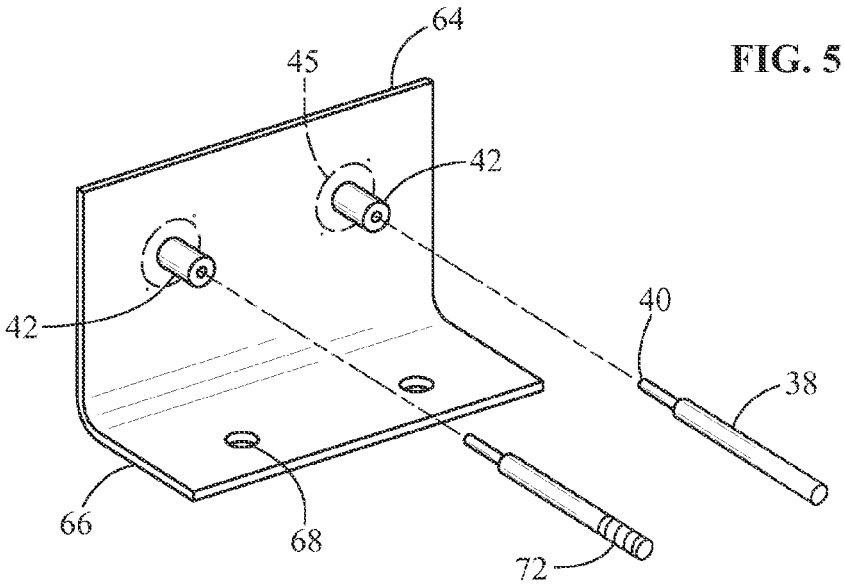
FIG. 6 shows an exploded perspective view of an exemplary illuminated panel according to the disclosure.
Figure 7:
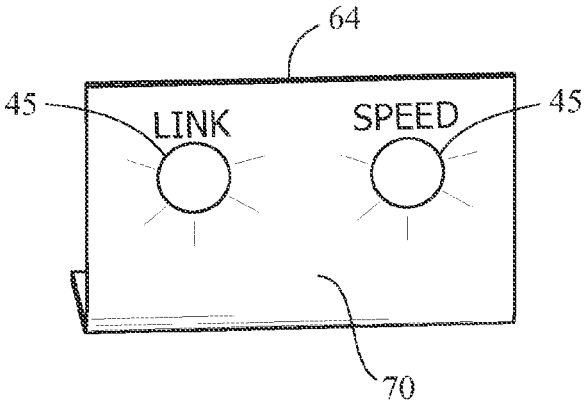
FIG. 7 shows a front view of the illuminated panel of FIG. 6 according to the disclosure.

As further shown in FIG. 1, body 28 includes a pair of passageways 34, with each passageway 34 configured to receive an end 36 of a corresponding fiber optic cable 38 therein. As further shown in FIG. 1, in response to cable connector 12 being directed inside of receptacle 16, creating an operative connection with receptacle 16, an end 30 of body 28 is brought into close proximity with a pair of illumination regions 32 of receptacle 16, as previously discussed. In one embodiment, receptacle 16 can include one illumination region 32, while in another embodiment, receptacle 16 can include three or more illumination regions 32. As a result of end 30 of body 28 being brought into close proximity with the pair of illumination regions 32 of receptacle 16, cable connector 12 is configured to provide visual evidence of the interconnection between receptacle 16 and cable connector 12. Such visual evidence is achieved as a result of the ends 36 of fiber optic cables 38 being brought into close proximity with the corresponding illumination regions 32 such that illumination from the illumination regions 32 are transmitted by the fiber optic cable 38 to another location for viewing. For example, as collectively shown in FIGS. 1, 2 6 and 7, illumination from illumination regions 32 of receptacle 16 are transmitted by corresponding ends 36 of fiber optic cable 38 inserted in body 28 to corresponding opposed ends 40 (FIG. 6) of the fiber optic cables 38. Ends 40 of fiber optic cables 38 are inserted in corresponding fittings 42 of diffusers 45 secured by a bracket 64 to form a panel 70 (FIG. 7), with diffusers 44 configured to be sufficiently illuminated by illumination regions 32 of receptacle 16 transmitted by the fiber optic cables 38 so as to be visually evident, such as by a technician wishing to confirm the integrity of the interconnection between cable connector 12 and receptacle 16 of device 18. As further shown in FIG. 6, bracket 64 includes a flange 66 having openings 68 formed therethrough for receiving mechanical fasteners (not shown) for securing bracket 64 in a desired position for viewing diffusers 45 from a position remote from receptacle 16 of device 18 (FIG. 1).

In one embodiment, the fiber optic cable 38 generally extends in close proximity along at least a portion of the length of cable 14, such as by shrink sleeve, wire ties or the like, which helps to protect fiber optic cable 38.

In one embodiment, at least a portion of fiber optic cable 38, such as at least a portion of the protective sleeve surrounding the fiber optic filaments of fiber optic cable 38, is sufficiently transparent and or translucent, or the protective sleeve removed, such that the portion is visually evident, such as when end 36 of fiber optic cable 38 is in close proximity with illumination region 32. In one embodiment, at least a portion 72 of fiber optic cable 38 can be optically altered, for example the outer surface of the fiber optic protective sleeve and/or filaments are treated, such as by abrading, exposing the outer surface to a chemical or other technique, such that the portion of fiber optic cable 38 (i.e., the portion positioned between opposed ends of the fiber optic cable) is illuminated in response to illumination from illumination region 32 of one end of the fiber optic cable 38, so that the opposed end and/or the treated portion is visually evident.

Figure 4:
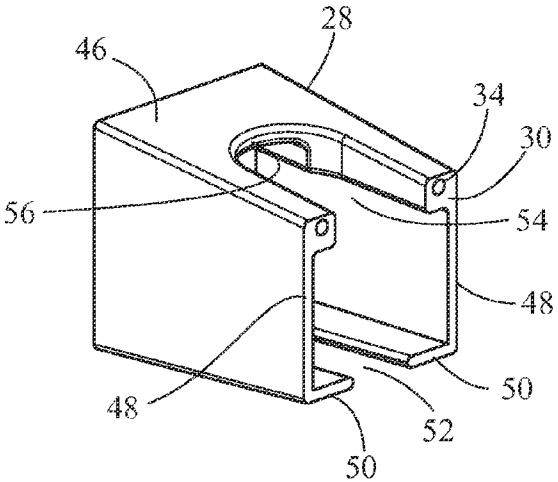
FIG. 4 shows an enlarged, reverse upper perspective view of the portion of the connection system of FIG. 3 according to the disclosure.
Figure 3:
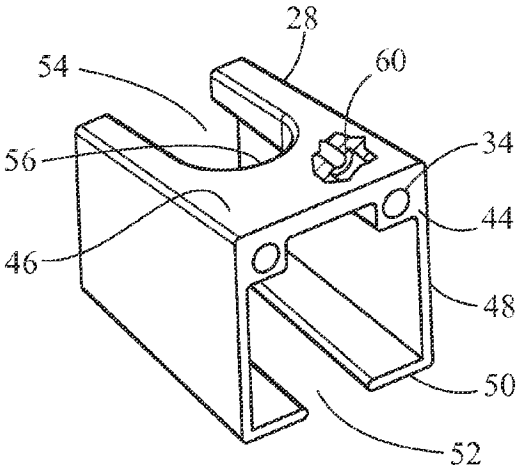
FIG. 3 shows an enlarged upper perspective view of a portion of the connection system of FIG. 1 according to the disclosure.

FIGS. 3 and 4 show opposed upper perspective views of body 28 including a base portion 46 extending to opposed walls 48 that further extend to flanges 50 which further extend toward each other and are separated by a spacing 52. Spacing 52 is sized to slide over cable 14 associated with cable connector 12. In one embodiment, body 28 is composed of a sufficiently resilient material such that spacing 52 can be less than the width of cable 14, while permitting cable 14 to be slid between spacing 52 such that cable 14 is substantially enclosed collectively by base portion 46, opposed walls 48 and opposed flanges 50. A recess 54 is formed in base portion 46 to receive protective feature 26 of cable connector 12. That is, once cable 14 is slid between spacing 52 of body 28, end 30 of body 28 can be continuously directed toward end 20 of cable connector 12 such that collectively, base portion 46, opposed walls 48 and opposed flanges 50 receive and substantially surround a portion of cable connector 12. End 30 body 28 is then continuously directed toward end 20 of cable connector 12 to further receive and substantially surround cable connector 12 until a base surface 56 of recess 54 abuts protective feature 26 of cable connector 12.

In one embodiment, cable connector 12 is collectively compressively secured by base portion 46, opposed walls 48 and opposed flanges 50 of body 28. Conversely, if desired, upon application of sufficient force to body 28 in a direction away from end 20 of cable connector 12, body 28 can be moved relative to cable connector 12 such that base portion 46, opposed walls 48 and opposed flanges 50 no longer surround any portion of cable connector 12. That is, base portion 46, opposed walls 48 and opposed flanges 50 of body 28 would only substantially surround a corresponding portion of cable 14, and by further directing body 28 in a direction away from cable 14 such that cable 14 slides between opposed flanges 50, body 28 can be completely separated from or removed from both cable connector 12 and cable 14. In one embodiment, body 28 does not include flanges 50, such that cable connector 12 can be sufficiently compressively secured to opposed walls 48 and base portion 46 with a surface 56 of recess 54 abutting protective feature 26 of cable connector 12. In one embodiment, body 28 can be secured to cable connector 12 by adhesive or mechanical fastener or other technique.

As shown collectively in FIGS. 1, 3 and 4, passageway 34 formed in body 28 extends from end 44 to opposed end 30. As further shown in FIG. 3, passageway 34 includes a shoulder 60 positioned between opposed ends 30, 44 such that the portion of passageway 34 extending from end 44 to shoulder 60 has a larger cross-sectional area than the remaining portion of passageway 34 extending from shoulder 60 to end 30. As a result, as collectively shown in FIGS. 1 and 3, a stripped portion 58 (a portion of fiber optic cable 38 in which an outer covering has been removed) and having an end 36 can be directed into passageway 34 in a direction toward shoulder 60 until a juncture 62 defining the end of stripped portion 58 of fiber optic cable 38 abuts shoulder 60, thereby preventing further insertion of fiber optic cable 38 in passageway 34. In one embodiment, passageway 34 is sized such that the cross-sectional area of fiber optic cable 38 is slightly larger than the cross-sectional area of passageway 34 between and end 44 and shoulder 60 of passageway 34, resulting in a compression fit between fiber optic cable 38 and passageway 34 and acting to retain the position of fiber optic cable 38 relative to body 28. Stated another way, upon insertion of fiber optic cable 38 into passageway 34 until juncture 62 abuts shoulder 60, fiber optic cable 38 is frictionally received in passageway 34.

Figure 5:
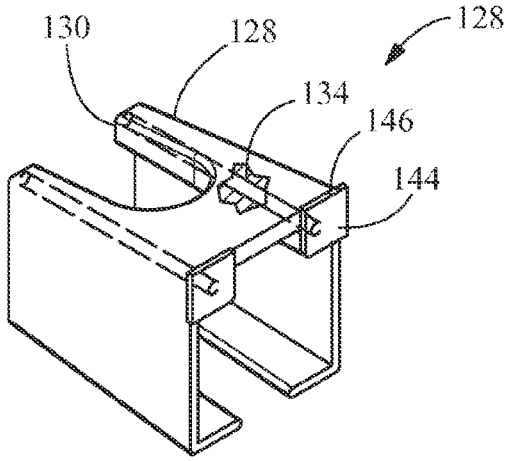
FIG. 5 shows an exemplary embodiment of an enlarged upper perspective view of a portion of the connection system of FIG. 1 according to the disclosure.

FIG. 5 shows body 128 which is an alternate embodiment of body 28. Body 128 includes opposed ends 144, 130 including a passageway 134 extending therebetween. However, body 128 further includes a diffuser 146 positioned at or in close proximity to end 144 that can be illuminated by the illumination region 32 (FIG. 1) when end 130 is brought into close proximity with the illumination region 32, which would occur when body 128 is secured to cable connector 12 and end 20 of cable connector 12 (FIG. 1) is directed into receptacle 16 of device 18 to form an interconnection therebetween. In other words, diffuser 146 is operatively associated with cable connector 12. Stated another way, in response to cable connector 12 forming an interconnection with receptacle 16 of device 18, the cable connector 12 can provide visual evidence of the interconnection between receptacle 16 and cable connector 12 due to illumination of diffuser 146 by illumination region 32. In one embodiment, diffuser 146 can be positioned between opposed ends 130, 144, and in another embodiment, at least a portion of body 28, 128 and/or cable connector 12 can be composed of a translucent or transparent material such that at least the corresponding portion of body 28, 128 and/or cable connector 12 is illuminated by illumination region 32 so as to provide visual evidence of the interconnection between receptacle 16 and cable connector 12 is previously discussed. In one embodiment, body 28, 128 does not include passageway 134, such as when at least a portion of body 28, 128 is at least partially configured/composed of a translucent, transparent or otherwise capable of being illuminated by illumination region 32 so as to provide visual evidence of the interconnection between receptacle 16 and cable connector 12. In one embodiment, at least a portion of body 28, 128 can be phosphorescent, such that while body 28, 128 may be neither transparent or translucent, at least a portion of body 28, 128 can be otherwise capable of being illuminated by illumination region 32 so as to provide visual evidence of the interconnection between receptacle 16 and cable connector 12.

Figure 8:
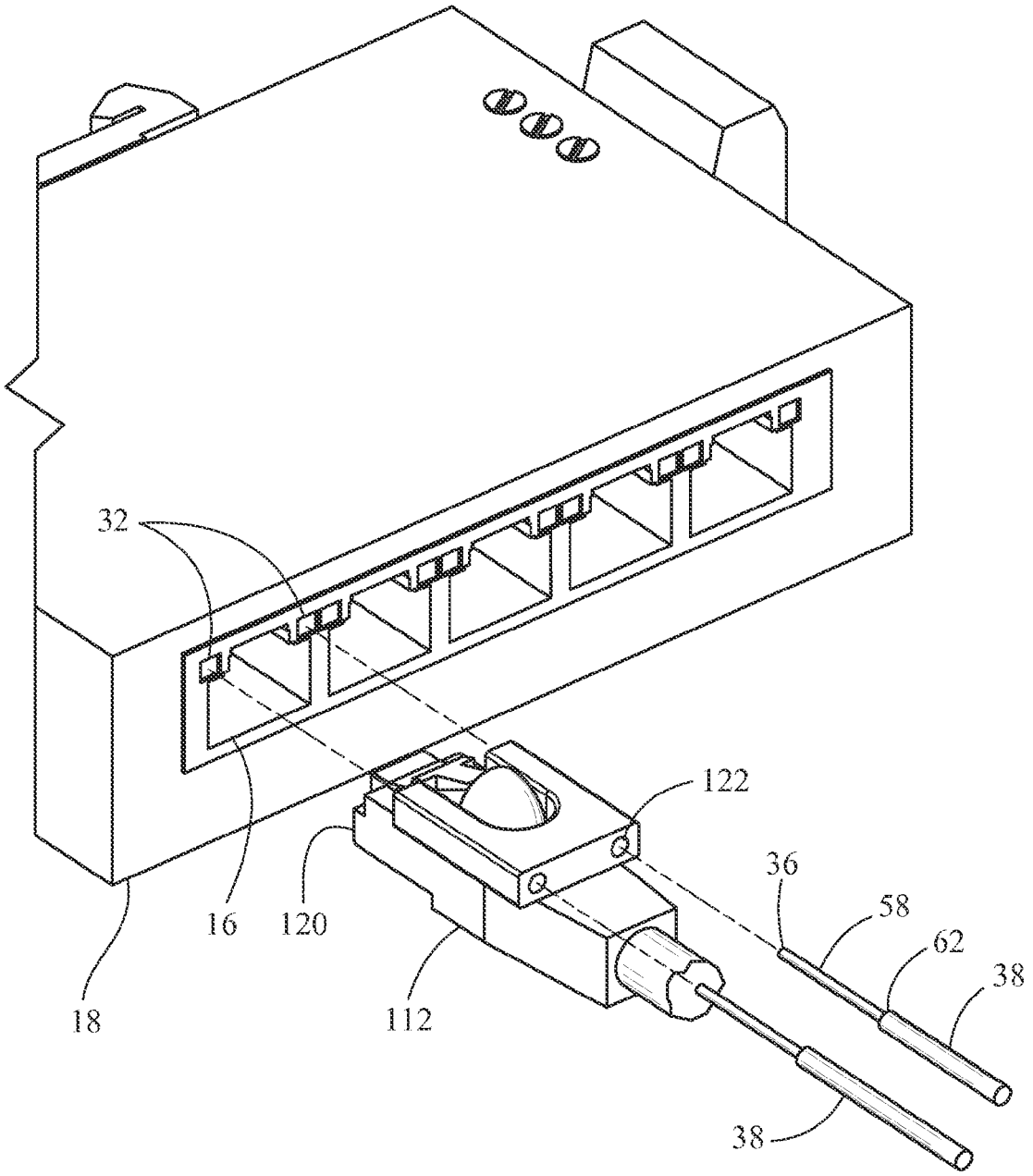
FIG. 8 shows an enlarged, partial exploded upper perspective view of an exemplary embodiment of a visually evident connection system according to the disclosure.

FIG. 8 shows an exemplary embodiment of cable connector 112 that incorporates body 28 into cable connector 12 (FIG. 1) in an integral or unitary (one-piece) construction. As further shown in FIG. 8, a passageway 122 is formed in cable connector 112 and configured to receive a fiber optic cable 38. In response to end 120 of cable connector 112 being directed into and forming an interconnection with receptacle 16 of device 18, the end 36 of fiber optic cable 38 is in close proximity with illumination regions 32 of receptacle 16 such that illumination from the illumination regions 32 are transmitted by the fiber optic cable 38 to another location for viewing. In one embodiment, at least a portion of the fiber optic cable 38 is optically altered, such that the portion of fiber optic cable 38 (i.e., the portion positioned between opposed ends of the fiber optic cable) is illuminated in response to illumination from illumination region 32 so as to be visually evident.

It is to be understood that irrespective the construction of cable connector 12, 124 or other constructions according to the present disclosure, the cable connectors are sized to permit interconnection with corresponding adjacent power/data receptacles 16, for example such as shown in device 18 (FIG. 1).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A visually evident connection system for a plug-in/power/data cable comprising: a power/data cable connector securable to a power/data cable, the connector configured to be received by a power/data receptacle having an illumination region in response to an interconnection between the connector and the receptacle, the system is configured to provide visual evidence of interconnection by illumination of a panel located remotely from the interconnection between the connector and receptacle, the source of illumination of the panel provided by the illumination region of the receptacle; said connector having a fiber optic cable such that illumination from the illumination region of the receptacle is transmitted by the fiber optic cable to the panel, wherein said panel has an element in close proximity to the end of the fiber optic cable of the connector that is illuminated by the illumination region of the receptacle.

2. The connection system of claim 1, wherein the panel is operatively associated with the connector.

3. The connection system of claim 1, wherein the illumination region is associated with at least one of connectivity of the receptacle with a power/data source and a data transmission speed or magnitude of electrical power associated with the power/data source.

4. The connection system of claim 1, wherein the plurality of connectors can be interconnected with corresponding adjacent power/data receptacles.

5. The connection system of claim 1, wherein the connector comprises a body securable thereto, the body comprising a passageway formed therein to receive a said fiber optic cable such that illumination from the illumination region of the receptacle is transmitted by the fiber optic cable to said panel.

6. The connection system of claim 5, wherein the body is removably securable to the connector.

7. The connection system of claim 5, wherein the fiber optic cable is frictionally received in the passageway.

8. The connection system of claim 5, wherein at least a portion of the fiber optic cable is optically altered, such that the portion of the fiber optic cable is illuminated in response to illumination from the illumination region.

9. The connection system of claim 8, wherein the portion of the fiber optic cable is translucent or transparent.

10. A visually evident connection system for a plug-in power/data cable comprising:

a body securable to a power/data cable connector configured to be received by a power/data receptacle having an illumination region associated with at least one of connectivity of the receptacle with a power/data source and a data transmission speed or magnitude of electrical power associated with the power/data source;

the body comprising a passageway formed therein to receive a fiber optic cable such that illumination from the illumination region of the receptacle is transmitted by the fiber optic cable;

in response to an interconnection between the connector and the receptacle, the fiber optic cable is configured to provide visual evidence of the interconnection by illumination of a panel operatively connected to an end of the fiber optic cable, the source of illumination of the component provided by the illumination region of the receptacle.

11. A method confirming a connection for a plug-in power/data cable comprising:

providing a power/data receptacle having an illumination region;

providing a power/data cable connector configured to be received by the power/data receptacle;

interconnecting the connector and the receptacle, wherein in response to an interconnection between the connector and the receptacle, a panel is configured to provide visual evidence of the interconnection by illumination wherein said panel is located remotely from said connector and receptacle, the source of illumination of the component provided by the illumination region of the receptacle.

12. The method of claim 11, wherein the illumination region is associated with at least one of connectivity of the receptacle with a power/data source and a data transmission speed or magnitude of electrical power associated with the power/data source.

* * * * *